252-98 AU 165 EX
9/13/77 XR 4,048,085

United States Patent [19]
Heslam

[11] 4,048,085
[45] Sept. 13, 1977

[54] PREPARATION OF DETERGENT COMPOSITIONS

[75] Inventor: Robin Snell Heslam, Wallasey, England

[73] Assignee: Lever Bros. Co., New York, N.Y.

[21] Appl. No.: 678,270

[22] Filed: Apr. 19, 1976

[30] Foreign Application Priority Data

Apr. 18, 1975 United Kingdom ..... 16147/75

[51] Int. Cl.² ..... C11D 7/54; C11D 7/60; C11D 7/32

[52] U.S. Cl. ..... 252/102; 252/95; 252/98; 252/525; 252/541; 252/544

[58] Field of Search ..... 252/544, 525, 102, 98, 252/95, 541

[56] References Cited

U.S. PATENT DOCUMENTS 3,741,913 6/1973 Waag ..... 252/544

*Primary Examiner*—Mayer Weinblatt
*Attorney, Agent, or Firm*—James J. Farrell; Kenneth F. Dusyn; Melvin H. Kurtz

[57] ABSTRACT

Process for preparing a detergent powder composition comprising forming an alkaline aqueous slurry of at least a surface-active agent, a builder salt and an organic activator for peroxy-compounds, and subjecting said aqueous slurry to a spray-drying operation to form a particulate detergent composition having the organic activator homogeneously distributed therein. The particulate detergent composition may be admixed with an inorganic persalt e.g. sodium perborate, and also with an enzyme, e.g. a proteolytic enzyme.

7 Claims, No Drawings

PREPARATION OF DETERGENT COMPOSITIONS

BACKGROUND OF THE INVENTION

1. Field of the Invention

The invention relates to a process for the preparation of a detergent powder composition containing a bleach activator for peroxy compounds. More particularly the invention relates to a method of incorporating an organic activator for peroxy compounds in detergent powder formulations. The invention also relates to a process for washing and/or bleaching textiles with the aid of a washing and/or bleaching liquid prepared from the detergent compositions according to the invention.

In the present context, the term "textiles" includes natural and synthetic fibres, as well as fabrics or products manufactured therefrom and therewith.

2. Description of the Prior Art

It is well-known in washing and/or bleaching textiles to make use of compositions containing inter alia peroxy compounds, particularly inorganic peroxy compounds, having a bleaching effect on the textiles to be treated. Examples of inorganic peroxy compounds are inorganic persalts, such as the alkali metal perborates, percarbonates, perphosphates, persilicates and persulphates, hydrogen peroxide and sodium peroxide. However, washing and/or bleaching compositions containing such inorganic peroxy compounds generally have the disadvantage that their bleaching effect is relatively low at temperatures below 80° C, which gives rise to difficulties when these compositions are used in machines for household purposes in which the temperature of the wash-water is not higher than 70° C. The addition of bleach activators, particularly organic activators for the peroxy compound, to such compositions is known, owing to which the active oxygen of the peroxy compound becomes effective also at temperatures below 80° C.

The exact mode of action of the organic activators is not known, but it is believed that organic peracids are formed by reaction of the organic activators with the inorganic peroxy compound, which peracids then liberate active-oxygen by decomposition.

Many organic activators are known in the art and have been extensively described in the literature. These are generally compounds which contain N-acyl or O-acyl residues in the molecule and which exert their activating action on the peroxy compounds on contact with these in the washing liquor.

A representative but by no means comprehensive list of known organic activators is given below:

1. Acyl organoamides of the formula $RCONR_1R_2$, where RCO is a carboxylic acyl radical, $R_1$ is an acyl radical and $R_2$ is an organic radical, as disclosed in U.S. Pat. No. 3,117,148.

Examples of compounds falling under this group are:

a. N,N-diacetylaniline and N-acetylphthalimide.
b. N-acylhydantoins, such as N,N'-diacetyl-5,5-dimethylhydantoin.
c. Polyacylated alkylene diamines, such as N,N,N¹N¹-tetraacetyl-methylene diamine and N,N,N¹,N¹-tetraacetyl-ethylene-diamine, as disclosed in British patent specification No. 907,356.

d. Acylated glycolurils, such as tetraacetylglycoluril, as disclosed in British patent specification No. 1,246,338.

2. Acylated sulphonamides, such as N-methyl-N-benzoylmenthane sulphonamide and N-phenyl-N-acetyl methane sulphonamide, as disclosed in U.S. Pat. No. 3,183,266.
3. Carboxylic esters of the type as disclosed in British patent specification No. 836,988. Examples of activators of this type include phenyl acetate, sodium acetoxy benzene sulphonate, trichloroethylacetate, sorbitol hexaacetate, fructose-pentaacetate, p-nitrobenzaldehyde diacetate, isopropenyl acetate, acetyl aceto hydroxamic acid, and acetyl salicylic acid. Other examples are esters of a phenol or substituted phenol with an alpha-chlorinated lower aliphatic carboxylic acid, such as chloroacetylphenol and chloroacetylsalicylic acid, as disclosed in U.S. Pat. No. 3,130,165.
4. Acyl-cyanurates, such as triacetyl- or tribenzoylcyanurates, as disclosed in U.S. Pat. No. 3,332,882.
5. Carbonic acid or pyrocarbonic acid esters of the formula $R_1OCOOR_2$ or $R_3OCO\text{-}OCO\text{-}OR_2$, as disclosed in British patent specification No. 970,950, for example p-carboxy-phenylethyl-carbonic acid ester, p-carboxyphenyl-ethyl pyrocarbonic acid ester, and sodium sulpho phenylethyl carbonic acid ester.
6. Optionally substituted anhydrides of benzoic or phthalic acid, for example benzoic anhydride, m-chlorobenzoic anhydride and phthalic anhydride.

The manufacture of detergent compositions, particularly fabric washing compositions, in the form of a coarse powder by the spray-drying technique is well-known, in which all the non-heat-sensitive and non-hydrolysable ingredients are slurried together with water to produce a fairly viscous paste which is pumped directly to a spray-jet of a tower where the product is both cooled and dried, in such a way that the resulting powder has a fairly large particle size with satisfactory solubility characteristics. The slurry generally comprises two basic ingredients, i.e., surface-active agents and builder materials. In addition thereto and if desired, other useful adjuncts and ingredients are generally present, such as fillers, e.g. sodium sulphate; lather stabilizers, e.g. coconut diethanolamide; lather depressants; soil-suspending agents, e.g. sodium carboxymethylcellulose; alkaline agents, e.g. alkaline silicates; optical brighteners; metal sequestering agents, e.g. ethylene diamine tetraacetate (EDTA), dyestuffs, etc.

Where the formulation requires the presence of a peroxy compound bleach, such as sodium perborate, it is not possible to include this ingredient in the detergent slurry which is fed to the spray-drying tower, since it would readily decompose with loss of active oxygen. In view of this, peroxy compounds are usually added to the final detergent powder after drying and cooling have taken place, and are mixed at the base of the spray-drying tower, i.e., secondary dosing. In preparing a detergent bleach composition which comprises also an organic activator for the peroxy compound, the organic activator being a hydrolysable material, is hitherto also added to the final detergent powder after drying and cooling have taken place, i.e., by the so-called secondary dosing. Not only does secondary dosing form an additional processing step requiring quite elaborate and accurate dosing systems, in view of difference in physical characteristics of the powders, it brings in also the risk of segregation in the pack during transport and storage.

Often, the organic activator, being a hydrolysable material, is further protected from moisture and the alkaline components of the detergent composition during storage, either by coating with an inert material or by forming particles in which the activator is imbedded in a carrier material, or by a combination of both. Various techniques and various coating and/or carrier materials have been suggested for use in this step which was hitherto thought desirable for preserving the detergent bleach compositions from deterioration. Such methods of protection are disclosed in e.g. British patent specifications Nos. 907,358, 1,204,123, 1,246,338 and 1,360,427 and Netherlands patent application 7205871.

DESCRIPTION OF THE INVENTION

It is an object of the present invention to provide a method for preparing a stable detergent powder composition containing an organic activator for peroxy compounds by the spray-drying technique in which the number of processing steps is reduced.

It is another object of the invention to provide a detergent powder composition containing an organic activator for a peroxy compound, wherein the activator is homogeneously distributed in the composition without segregation problems.

It is a further object of the invention to provide an improved method for preparing a detergent powder composition containing a peroxy compound and an organic activator therefor showing performance and stability comparable to similar detergent powder compositions wherein the organic activator is present in the form of separate particles.

These and other objects and advantages will be apparent in the following description:

According to the invention a process is provided which comprises forming an alkaline aqueous slurry comprising essentially a surface-active agent, a builder salt and an organic activator for peroxy compounds and subjecting said aqueous slurry to a spray-drying operation to form a particulate detergent composition having the organic activator homogeneously distributed therein.

Experiments have shown that N, N, N$^1$, N$^1$-tetraacetylethylenediamine (TAED), a well-known organic activator for peroxy compounds, when brought into solution at a pH = abt. 9, loses activity fairly quickly. This is in conformity with the hitherto general belief that organic activators are easily hydrolysable materials and that organic activators would readily decompose when incorporated in an alkaline detergent slurry and subjected to higher temperatures on spray-drying. Indeed, up to now the secondary dosing of organic activators in a form wherein the activator is imbedded in a carrier material, preferably as coated particles, into a detergent powder has been accepted as the most suitable way of incorporating said activators.

It has now been found unexpectedly and surprisingly that certain organic activators can be conveniently incorporated in an aqueous detergent slurry and the mixture subjected to spray-drying to give a good powder with substantially no loss of the organic activator. This is a dramatic advantage, not only from the viewpoint of processing technique but also of powder characteristics. A considerable simplification of processing technique is achieved, in that one elaborate secondary dosing step, frequently combined with special protecting treatments can be omitted. A further advantage is that the problem of segregation of the activator from the base powder during transport and storage is minimized, in that the activator is present as integral part of the detergent powder.

The aqueous detergent slurry for spray-drying according to the invention comprises generally about 1–20% of a surface-active agent, about 5–40% of builder salts, and about 0.2–10% of the organic activator, and optionally other usual adjuncts. It has normally an alkaline pH (measured on 1% solid solution) of about 8.5–12 and is generally heated to a temperature of about 60° to about 90° C prior to being spray-dried. It has been discovered that both alkalinity and temperature of the slurry are no critical factors for the present invention and that the activator can be added to a detergent slurry within the conventional range of alkalinity and temperature. A preferable slurry pH range — measured on 1% solid solution — is from about 9–10.5, a preferable slurry temperature range is about 65–85° C. In preparing the slurry the activator is preferably added to the slurry as the last ingredient.

Depending upon the activator level that is contemplated in the final detergent powder formulation, the amount of activator added to the slurry for spray-drying may vary from about 0.2–10% by weight, preferably from 0.5–7.5% by weight, based on the total slurry composition, having a water content of about 40–60% by weight.

It is furthermore established that the organic activator containing slurry can be spray-dried under substantially normal conditions, i.e., using a stream of air having an inlet temperature of about 250°–400° C, preferably between 275°–350° C, and an outlet temperature of about 100°–125° C, preferably between 100°–115° C.

Preferred groups of organic activators for use in the present invention are acyl organoamides, including acyl sulphonamides, acyl cyanurates and carbonic or pyrocarbonic acid esters.

Typical examples of activators within these groups are polyacylated alkylene diamines, such as N, N, N$^1$, N$^1$-tetraacetylethylene diamine (TAED) and N, N, N$^1$, N$^1$-tetraacetylmethylene diamine (TAED); acylated glycolurils, such as tetraacetylglycoluril (TAGU); triacetylcyanurate and sodium sulphophenyl ethyl carbonic acid ester.

A particularly preferred activator according to the invention is N, N, N$^1$, N$^1$-tetraacetylethylene diamine (TEAD).

A convenient way for assessing the suitability of an organic activator for use in the present invention is by measuring the hydrolysis rate using the following test method:

A slurry of 60° C is prepared from:

35 gms sodium dodecyl benzene sulphonate
9 gms anhydrous soap
9 gms tallow alcohol/18 ethylene oxide
197 gms sodium triphosphate
275 gms water
25 gms organic activator.

The activator is added last and comprises 9% of the slurry solids.

After 60 seconds and after 60 minutes a weighed sample of the slurry is withdrawn, dissolved in water at 20° C and a standard solution of hydrogen peroxide is added to give 1.5:1 equivalence to the activator.

This solution is heated to 60° C over 30 minutes, during which time aliquots are withdrawn to determine the peracid level. The difference in maximum peracid level between the two samples is a measure of the hydrolysis rate of the activator.

Organic activators showing a hydrolysis rate such that nor more than 15% is lost during the test are quite suitable and are therefore preferred for use in the present invention.

In the following Table some commonly known organic activators and their respective hydrolysis rates measured according to the standard test method are listed:

| Activator | % activator remaining |
|---|---|
| TAMD | 89 |
| TAED | 100 |
| TAGU | 100 |
| Sodium sulphophenyl ethyl carbonic acid ester | 91 |
| Acetyl salicylic acid | 78 |
| Phthalic anhydride | 49 |
| Sodium acetoxy benzene sulphonate | 60 |

The first four listed activators are definitely suitable activators for use in the invention.

Acetyl salicylic acid is less suitable; phthalic anhydride and sodium acetoxy benzene sulphonate are much less suitable materials, in view of their high hydrolysis rate.

The invention is applicable to incorporating an organic activator in substantially any conventional detergent composition comprising generally a surface-active agent, which may be anionic, nonionic, zwitterionic or amphoteric, cationic or mixtures thereof, builder materials, which may be inorganic or organic or mixtures thereof, a peroxy compound and optionally other adjuncts and ingredients usually added to detergent bleach compositions, such as foam stabilizers, foam inhibitors, corrosion inhibitors, anti-redeposition agents, soil-suspending agents, fillers, alkaline agents, optical bleaching agents, sequestrants, dyestuffs, enzymes etc.

In one embodiment of the invention a detergent powder composition is provided which generally comprises the components in the following relative proportions:

1. 2–40%, preferably 5–25% by weight of surface-active agents or mixtures of surface-active agents, comprising:
   - 0–100%, preferably 20–65% by weight of synthetic anionic surface-active compounds of the sulphonate and/or sulphate type.
   - 0–100%, preferably 5–50% by weight of nonionic surfce-active compounds.
   - 0–100%, preferably 5–50% by weight of an alkali-metal soap of $C_8$–$C_{22}$ fatty acids.
2. 0–5%, preferably 0.5–3% by weight of a foam stabilizer.
3. 0–5%, preferably 0.5–3% by weight of a foam inhibitor.
4. 10–80%, preferably 25–70% by weight of builder material and alkaline agents.
5. 2–40%, preferably 4–35% by weight of a peroxy compound, e.g. sodium perborate, sodium percarbonate, etc.
6. 0–30%, preferably 2–20% by weight of fillers.
7. 0.5–20%, preferably 1–15% by weight of an organic activator.
8. 0–20%, preferably 2–15% by weight of other adjuncts and ingredients, such as for example optical brighteners, soil-suspending agents, dyestuffs, perfume, enzymes, and moisture.

Typical synthetic anionic surface-active compounds are the alkyl benzene sulphonates having from 8–16 carbon atoms in the alkyl group, e.g. sodium dodecyl benzene sulphonate; the aliphatic sulphonates, e.g. $C_8$–$C_{18}$ alkane sulphonates; the olefin sulphonates having from 10–20 carbon atoms, obtained by reacting an alpha-olefin with gaseous diluted sulphur trioxide and hydrolysing the resulting product; the alkyl sulphates such as tallow alcohol sulphate; and further the sulphation products of ethoxylated and/or propoxylated fatty alcohols, alkyl phenols with 8–15 carbon atoms in the alkyl group, and fatty acid amides, having 1–8 moles of ethylene or propylene groups.

Typical nonionic surface-active compounds are the condensation products of alkyl phenols having 5–15 carbon atoms in the alkyl group with ethylene oxide, e.g. the reaction product of nonyl phenol with 6–30 ethylene oxide units; the condensation products of higher fatty alcohols, such as tridecyl alcohol and secondary $C_{10}$–$C_{15}$ alcohols, with ethylene oxide, known under the trade-name of "Tergitols"® supplied by Union Carbide; the condensation products of fatty acid amide with 8–15 ethylene oxide units and the condensation products of polypropylene glycol with ethylene oxide.

Suitable foam stabilizers are e.g. the surface-active carboxy- or sulpho-betaines, and the fatty acid alkylolamides.

Foam inhibition can be obtained with long chain fatty acids having from 20–26 carbon atoms in the molecule, or with non-surface-active water insoluble hydrocarbon compounds, such as paraffins or halogenated paraffins with melting points below 100° C. Hydrocarbon compounds may be incorporated in the slurry or may be sprayed on to the spraydried powder.

Suitable builders are weakly acid, neutral or alkaline reacting, inorganic or organic compounds, especially inorganic or organic complex-forming substances, e.g. the bicarbonates, carbonates, borates or silicates of the alkali-metals; the alkali-metal ortho-, meta-, pyro- and tripolyphosphates; nitrilotriacetic acid and ethylene diamine tetra-acetate.

Usual fillers are the alkali-metal sulphates, especially sodium sulphate.

In preparing the detergent composition according to the invention these and other non-heat-sensitive and non-hydrolysable adjuncts including an organic activator as defined hereinbefore will be formed to a slurry, which is then spray-dried according to known techniques.

Any other adjuncts as desired, e.g. peroxy compounds, enzymes and perfumes, may be added as usual in a secondary dosing step.

The detergent bleach composition of the invention can be suitably used for washing and/or bleaching of textiles at lower temperatures, i.e., between 20°–70° C, and is equally suitable for use in the high temperature wash, i.e., at temperatures between 70° C and the boil.

Apart from washing and/or bleaching at lower temperatures, an additional advantage of detergent powder compositions comprising an organic activator for the peroxy compound is that the level of peroxy compound in the formulation can be lowered without substantially affecting the washing and/or bleaching performance.

EXAMPLES I–III

The behaviour of N, N, N¹, N¹-tetraacetylethylene diamine (TAED) in three base-powder formulations I–III prepared according to the invention was examined.

| Components (in % by weight) | I | II | III |
|---|---|---|---|
| Sodium $C_{10}$–$C_{12}$ alkyl benzene sulphonate | 9.0 | 8.8 | 7.5 |
| Sodium tallow soap | 2.0 | — | — |
| Sodium hardened tallow soap | — | — | 4.4 |
| Tallow alcohol/10 ethylene oxide | 1.7 | — | — |
| Tallow amide/11 ethylene oxide | — | 8.8 | 3.1 |
| Sodium triphosphate | 51.2 | 49.0 | 50.0 |
| Sodium sulphate | 15.4 | 4.0 | 7.1 |
| Ethylene diamine tetraacetate | 0.1 | 0.3 | 0.2 |
| Sodium carboxymethyl cellulose | 1.1 | 1.4 | 1.3 |
| Optical bleach + miscellaneous | 0.2 | 0.3 | 0.2 |
| TAED | 7.8 | 10.0 | 8.8 |
| Water | 11.5 | 17.4 | 17.4 |

Slurries were made batchwise (300 kg) with TAED added at last ingredient and heated to 80° C. Spray-drying was carried out in a 1.8 meter tower using standard operating conditions, i.e., 300° C inlet air temperature; 100° C outlet air temperature; powder throughput 5–6 kg/min; blow duration 30 minutes.

The slurries were prepared by mixing the ingredients in water in the following quantities:

| Slurry | I (kg) | II (kg) | III (kg) |
|---|---|---|---|
| Sodium $C_{10}$–$C_{12}$ alkyl benzene sulphonate | 15.3 | 16.0 | 13.7 |
| Sodium tallow soap | 3.4 | — | — |
| Sodium hardened tallow soap | — | — | 8.0 |
| Tallow alcohol/10 ethylene oxide | 2.9 | — | — |
| Tallow amide/11 ethylene oxide | — | 16.0 | 5.7 |
| Sodium triphosphate | 86.7 | 89.0 | 91.0 |
| Sodium sulphate | 25.9 | 7.3 | 13.0 |
| Ethylene diamine tetraacetate | 0.2 | 0.5 | 0.4 |
| Sodium carboxymethyl cellulose | 1.8 | 2.5 | 2.4 |
| Optical bleach + miscellaneous | 0.35 | 0.5 | 0.4 |
| TAED | 13.5 | 18.2 | 16.0 |
| Water | 150.0 | 150.0 | 150.0 |

TAED stability was assessed throughout the processing stages and also in the final powders.

The results of these examinations were:

1. TAED was stable in slurries over the pH range of 9.2–9.4 (measured on 1% solution) at the working temperature of 80° C; no decomposition was detected over an 1 hour ageing period.
   Slurry rheology was not affected by TAED and conventional slurry moisture contents (about 45–50%) can be used.
2. Concentrations of organic volatile in the tower exhaust gases were low, and compare favourably with levels found in processing conventional powders, which is indicative to the very low loss of organic activator in the blown powder.
3. Powders blown to nominal moisture contents (about 12–14%) contained the required level of TAED, confirming the low loss of TAED as monitored during processing. The powder exhibited satisfactory performance characteristics and showed no apparent loss of TAED after 2 weeks' storage under ambient conditions.

EXAMPLE IV

One detergent powder composition of the following nominal formulation was prepared by spray-drying in a slurry composition as given below:

| Components | Slurry (in parts by weight) | Powder (in parts by weight) |
|---|---|---|
| Sodium $C_{10}$–$C_{12}$ alkyl benzene sulphonate | 8.0 | 8.0 |
| Sodium tallow soap | 2.0 | 2.0 |
| Tallow alcohol/10 ethylene oxide | 1.5 | 1.5 |
| Sodium triphosphate | 46.0 | 46.0 |
| Ethylene diamine tetraacetate | 0.1 | 0.1 |
| Sodium carboxymethylcellulose | 1.0 | 1.0 |
| Sodium sulphate | 13.8 | 13.8 |
| Optical brightener | 0.2 | 0.2 |
| Water | 73.0 | 10.0 |

Into portions of this spray-dried powder there were mixed in "spherical" particles comprising 80%, N, N, N¹, N¹-tetraacetylethylene diamine (TAED) and 20% carrier material (noodles) in an amount corresponding to 4.3% by weight of TAED based on the final composition and sodium perborate tetrahydrate in various amounts.

Another detergent powder composition of similar nominal formulation was prepared by spray-drying a slurry in which however TAED was incorporated, in an amount corresponding to 4.3% TAED based on the final composition. The spray-drying conditions of Examples I–III were followed.

Into this second spray-dried powder sodium perborate tetrahydrate was mixed in, also in various amounts.

These detergent bleach powder compositions were subjected to a storage test of 4 weeks in plastic bags at 37° C/70% relative humidity.

The results are given in the following table:

| TAED/perborate equivalence ratio | TAED noodles % remaining | | TAED spray-dried % remaining | |
|---|---|---|---|---|
| | TAED | perborate | TAED | perborate |
| 1 : 1.0 | 95 | 90 | 89 | 97 |
| 1 : 1.25 | 88 | 93 | 84 | 97 |
| 1 : 1.5 | 84 | 94 | 81 | 90 |
| 1 : 1.75 | 81 | 98 | 89 | 97 |
| 1 : 2.0 | 100 | 87 | 88 | 93 |

These results show that within the usual equivalent ratio range there is substantially no difference in the stability of both perborate and activator in compositions prepared according to the invention and in compositions wherein the activator is present as noodles which were hitherto considered as being the most suitable form of addition.

PREPARATION OF TAED NOODLES

The TAED noodles were prepared on a pilot scale by a 7-stage process involving:

1. slurry making (50:50 TAED/water)
2. colloid milling
3. drum drying
4. mixing
5. extruding
6. spheronizing
7. sieving.

The first three operations converted the TAED from a pale brown crystalline material into a fine white powder. The finely divided TAED was then mixed with tallow alcohol/18 ethylene oxide and citric acid in the ratio 80:19:1 prior to extrusion in a Beken planetary mixer. The noodles (0.7 mm diameter) from the extruder were in the form of long strands which were broken down to a length of about 2 mm or less in a spheronizing apparatus in order to match their appearance with the base powder.

Oversize material was removed by sieving the "spheronized" noodles through a 10 mesh B.S. sieve.

EXAMPLE V

An enzymatic detergent powder composition was prepared by dry-mixing the spray-dried base powder of Example I with 1% by weight of a proteolytic enzyme "Alcalase" (activity 1 Anson unit/gram) and sodium perborate tetrahydrate (equivalence ratio TAED:perborate = 1:1.5).

The powder was stored for one week in plastic bags at 37° C/70% R.H. and analyzed for % remaining enzyme, TAED and sodium perborate.

The results are given below:

| % remaining | | |
|---|---|---|
| Enzyme | TAED | Perborate |
| 88 | 100 | 95 |

I claim:

1. A process for preparing a detergent powder composition comprising the steps of forming an alkaline aqueous slurry having a pH value (measured on a 1% solids solution) of about 8.5 to 12 and comprising a surface-active agent selected from the group consisting of anionic, nonionic, zwitterionic, amphoteric and cationic detergents and mixtures thereof in an amount of about 1–20% by weight; a builder salt selected from the group consisting of inorganic and organic complex-forming substances and mixtures thereof in an amount of about 5–40% by weight, an organic activator for peroxy compounds having a hydrolysis rate of not more than 15%, in an amount of about 0.2–10% by weight; and water in an amount of about 40–60% by weight, heating said aqueous slurry to a temperature of about 60°–90° C, and subjecting it to a spray-drying operation to form a particulate detergent composition having the organic activator homogeneously distributed therein.

2. A process according to claim 1, wherein to said particulate detergent composition is added a peroxy compound in an amount such that the final composition comprises 2–40% by weight of said peroxy compound.

3. A process according to claim 1, wherein the slurry is spray-dried at an inlet air temperature of about 275°–350° C and an outlet air temperature of about 100°–115° C.

4. A process according to claim 1 wherein the aqueous slurry has a pH value (measured on 1% solid solution) of about 9–10.5 and is heated to about 65°–85° C prior to being spray-dried.

5. A process according to claim 1, wherein the organic activator comprises about 0.5–7.5% by weight of the total slurry composition.

6. A process according to claim 1, wherein the organic activator is selected from the group consisting of acyl organo amides of the formula $RCONR_1R_2$, where RCO is a carboxylic acid radical, $R_1$ is an acyl radical and $R_2$ is an organic radical, and carbonic or pyrocarbonic acid esters of the formula $R_1OCOOR_2$ or $R_3OCO\text{-}OCO\text{-}OR_2$ and the mixtures thereof.

7. A process according to claim 6, wherein the organic activator is N, N, $N^1$, $N^1$-tetraacetylethylene diamine.

* * * * *